US012207742B2

(12) United States Patent
Eden

(10) Patent No.: US 12,207,742 B2
(45) Date of Patent: Jan. 28, 2025

(54) PULLOUT SHELF

(71) Applicant: Keith C. Eden, Loves Park, IL (US)

(72) Inventor: Keith C. Eden, Loves Park, IL (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/483,222

(22) Filed: Oct. 9, 2023

(65) Prior Publication Data

US 2024/0130541 A1 Apr. 25, 2024
US 2024/0225310 A9 Jul. 11, 2024

Related U.S. Application Data

(60) Provisional application No. 63/418,860, filed on Oct. 24, 2022.

(51) Int. Cl.
*A47F 5/00* (2006.01)
*A47B 96/02* (2006.01)
(Continued)

(52) U.S. Cl.
CPC ..... *A47F 5/0093* (2013.01); *A47B 96/025* (2013.01); *A47F 5/0043* (2013.01);
(Continued)

(58) Field of Classification Search
CPC .... A47F 5/0093; A47F 5/0043; A47F 5/0081; A47F 5/0846; A47B 46/00; A47B 47/00; A47B 47/021; A47B 47/022; A47B 57/00; A47B 57/06; A47B 57/08; A47B 57/16; A47B 57/30; A47B 57/40; A47B 57/42; A47B 57/46; A47B 88/40; A47B 96/02;
(Continued)

(56) References Cited

U.S. PATENT DOCUMENTS 3,356,328 A * 12/1967 Sachau ..... A47B 57/56 248/245
3,885,846 A * 5/1975 Chuang ..... F25D 25/02 211/187
(Continued)

FOREIGN PATENT DOCUMENTS

NL 9301698 A 5/1995
WO WO 2008/021841 A2 2/2008

*Primary Examiner* — Devin K Barnett
(74) *Attorney, Agent, or Firm* — Reinhart Boerner Van Deuren P.C.

(57) ABSTRACT

A pullout shelf assembly for a retail merchandise display including a shelf, an adjustable length support arm and a latch arrangement is provided. The shelf has a product support surface. The first adjustable length support arm has first and second arm members movable relative to one another between a retracted position and a first extended position. The shelf moves with the second arm member. The latch arrangement has a first catch associated the retracted position and a second catch associated with the first extended position. A latch bolt secures the second arm member in the retracted position when engaged with the first catch and secures the second arm member in the first extended position when engaged with the second catch. The handle operably actuates the latch bolt out of engagement with the first and second catches to permit movement of the second arm member relative to the first arm member.

16 Claims, 14 Drawing Sheets

(51) Int. Cl.

| | |
|---|---|
| *A47B 46/00* | (2006.01) |
| *A47B 57/00* | (2006.01) |
| *A47B 57/06* | (2006.01) |
| *A47B 57/40* | (2006.01) |
| *A47B 88/40* | (2017.01) |

(52) U.S. Cl.
CPC ..... *A47B 46/00* (2013.01); *A47B 57/00* (2013.01); *A47B 57/06* (2013.01); *A47B 57/40* (2013.01); *A47B 88/40* (2017.01); *A47B 2210/00* (2013.01); *A47B 2220/0022* (2013.01)

(58) Field of Classification Search
CPC . A47B 96/025; A47B 96/027; A47B 2210/00; A47B 2220/0022
See application file for complete search history.

(56) References Cited

U.S. PATENT DOCUMENTS 6,021,909 A * 2/2000 Tang ..... H05K 7/1421 211/183
6,799,523 B1 * 10/2004 Cunha ..... A47F 5/0093 108/143
7,258,317 B1 * 8/2007 Nagel ..... A47B 96/025 108/143
7,318,532 B1 * 1/2008 Lee ..... H05K 7/1405 403/379.5
8,020,714 B2 * 9/2011 Miller, Jr. ..... A47F 3/0404 108/107
8,333,448 B2 * 12/2012 Yoon ..... A47B 96/028 312/351
8,419,143 B2 * 4/2013 Shin ..... F25D 25/02 312/408
8,490,801 B2 * 7/2013 Smith ..... F24C 15/16 126/339
8,800,785 B2 * 8/2014 Kalafut ..... A47F 5/0861 211/119.003
9,044,089 B1 * 6/2015 Sandhu ..... A47F 5/0093
9,681,574 B1 * 6/2017 Chen ..... H05K 7/1489
2004/0094492 A1 * 5/2004 Greenwald ..... H05K 7/1421 211/26
2006/0170234 A1 * 8/2006 Cooley ..... B60P 3/14 296/26.09
2008/0035589 A1 * 2/2008 Rasmussen ..... A47F 1/126 211/59.3
2014/0190917 A1 * 7/2014 Szpak ..... A47B 96/024 211/134
2014/0305891 A1 * 10/2014 Vogler ..... A47F 1/126 211/59.3
2022/0260799 A1 * 8/2022 Van Baelen ..... G02B 6/4455
2022/0312959 A1 * 10/2022 Hanley ..... A47B 96/067

* cited by examiner

PULLOUT SHELF

CROSS-REFERENCE TO RELATED PATENT APPLICATIONS

This patent application claims the benefit of U.S. Provisional Patent Application No. 63/418,860, filed Oct. 24, 2022, the entire teachings and disclosure of which are incorporated herein by reference thereto.

FIELD OF THE INVENTION

This invention generally relates to a pullout shelf for a retail merchandise display system.

BACKGROUND OF THE INVENTION

Retail shelving is a staple in the retail merchandise display system industry. While such shelving comes in many forms, it generally includes a vertical support structure which supports one or more shelves extending outwardly from the vertical support structure. The vertical support structure is typically a wall-like structure and contains mounting rails, referred to in in the industry as gondola uprights, to which the shelves mount.

The system may include multiple such shelves vertically spaced from one another. One issue with the vertically spaced shelves is that it can be difficult to access merchandise located at the rear of the shelf due to the existence of an adjacent upper shelf vertically above the shelf on which the desired merchandise is located. This can be particularly true for products that have a height that is similar to the vertical spacing between the adjacent shelves.

Accordingly, there is a need in the art for a retail shelving system which addresses the above drawbacks of existing shelving systems.

BRIEF SUMMARY OF THE INVENTION

Examples provide a new and improved pullout shelf for use with a retail merchandise display system. New and improved retail merchandise display systems incorporating a pullout shelf are also provided.

In a particular example, a pullout shelf assembly for a retail merchandise display including a shelf, an adjustable length support arm and a latch arrangement is provided. The shelf has a product support surface extending between a front side and a rear side as well as between spaced apart first and second lateral sides that extend between the front and rear side. The first adjustable length support arm is proximate the first side. The first adjustable length support arm has first and second arm members. The second arm member is movable relative to the first arm member parallel to a sliding axis between a retracted position and a first extended position. The shelf is operably attached to the second arm member to move with the second arm member when the second arm member is moved between the retracted and first extended positions. The latch arrangement has a first catch associated with and having a fixed position relative to the first arm member establishing the retracted position. The latch arrangement has a second catch associated with and having a fixed position relative to the first arm member establishing the first extended position. A latch bolt is selectively engageable with and disengageable from the first and second catches. The latch bolt securing the second arm member in the retracted position when engaged with the first catch and securing the second arm member in the first extended position when engaged with the second catch. The latch bolt secures the first arm member relative to the second arm member when the latch bolt is engaged with either the first catch or second catch. The handle is operably attached to the latch bolt to actuate the latch bolt out of engagement with the first and second catches when in the retracted and first extended positions, respectively to permit movement of the second arm member relative to the first arm member.

In one example, the latch bolt and handle are operably carried by the shelf such that the latch bolt and handle move with the shelf when the second arm member is moved relative to the first arm member.

In one example, the handle moves parallel to the sliding axis to actuate the latch bolt. The latch bolt moves relative to the shelf and the first arm member parallel to, at least, a latch bolt axis that is generally perpendicular to the sliding axis when the latch bolt is disengaged from the first and second catches. The latch assembly further includes a pivot link operably connecting the handle to the latch bolt. The pivot link pivoting about a pivot axis that is generally perpendicular to the sliding axis and the latch bolt axis to convert motion of the handle parallel to the sliding axis into motion of the latch bolt parallel to the latch bolt axis.

In one example, actuation of the handle in a first direction parallel to the sliding axis pivots the pivot link about the pivot axis in a first angular direction causing the latch bolt to actuate in a second direction parallel to the latch bolt axis to disengage the latch bolt from the first catch when the second arm member is in the retracted position.

In one example, actuation of the handle in a third direction parallel to the sliding axis, e.g. opposite the first direction, pivots the pivot link about the pivot axis in a second angular direction, e.g. opposite the first angular direction, causing the latch bolt to actuate in a fourth direction, e.g. opposite the second direction, parallel to the latch bolt axis to engage the latch bolt with the first catch when the second arm member is in the retracted position and with the second catch when the second arm member is in the first extended position.

In one example, a biasing member operably biases the latch bolt in the fourth direction, the pivot link in the second angular direction, and the handle in the third direction such that no other external force is required to be applied to the handle to transition the latch bolt from being disengaged from the first and second catches into engagement with the first and second catches, when the second arm is in the retracted and first extended position, respectively.

In one example, a first cam member is fixed relative to the second catch. The latch bolt has a second cam member that engages the first cam member. The first and second cam members are configured such that when a predetermined external force is applied to the shelf to move the shelf from the first extended position toward the retracted position with the latch bolt engaged with the second catch, the latch bolt is actuated out of engagement with the second catch such that an external force need not be applied to the handle to disengage the latch bolt and the second catch.

In one example, a first cam member is fixed relative to the second catch. The latch bolt has a second cam member that engages the first cam member. The first and second cam members configured such that when a predetermined external force is applied to the shelf to move the shelf from the first extended position toward the retracted position with the latch bolt engaged with the second catch, the latch bolt is actuated out of engagement with the second catch such that an external force need not be applied to the handle to disengage the latch bolt and the second catch. The first and second cams cooperate to actuate the latch bolt parallel to the latch bolt axis when the predetermined external force is applied to the shelf parallel to the sliding axis.

In one example, the second catch is a notch provided by the first arm member. The notch has (or is defined between) first and second abutment surfaces. The first abutment surface is more proximate the first end of the first arm member than the second abutment surface. The second abutment surface is more proximate the second end of the first arm member. The first abutment surface inhibits motion of the shelf away from the retracted position when engaged by the latch bolt. The second abutment surface inhibits motion of the shelf towards the retracted position when engaged by the latch bolt.

In one example, the second catch is a notch provided by the first arm member. The notch has (or is defined between) first and second abutment surfaces. The first abutment surface is more proximate the first end of the first arm member than the second abutment surface. The second abutment is being proximate the second end of the first arm member. The first abutment surface inhibits motion of the shelf away from the retracted position when engaged by the latch bolt. The second abutment surface inhibits motion of the shelf towards the retracted position when engaged by the latch bolt. The second abutment surface provides the second cam member.

In one example, the first adjustable length support arm has a first length when the shelf is in the retracted position and a second length greater than the first length when the shelf is in the first extended position.

In one example, the first and second lengths are defined by a rear end of the first arm member and a front end of the second arm member.

In one example, the second arm member has a second extended position relative to the first arm member. The second extended position being located between the retracted position and the first extended position. The latch arrangement has a third catch associated with and having a fixed position relative to the first arm member establishing the second extended position. The third catch being axially positioned between the first and second catches parallel to the sliding axis.

In one example, the first arm member includes a mounting hook for mounting the first arm member in a cantilevered orientation to a vertically oriented shelf support. The shelf moving away from the mounting hook when transitioning from the retracted position toward the first extended position.

In one example, the first arm member extends generally parallel to the sliding axis between a front end and a rear end. The first arm member includes a vertically oriented wall portion and a plurality of horizontally extending flange portions. The plurality of horizontally extending flange portions extending toward the handle from the vertically oriented wall portion. A first pair of adjacent ones of the plurality of horizontally extending flange portions defines the first catch therebetween. The second pair of adjacent ones of the plurality horizontally extending flange portions defines the second catch therebetween.

In one example, the first arm member includes a bottom horizontally extending flange portion extending from the vertically oriented wall portion. The bottom horizontally extending flange portion is spaced vertically from the plurality of horizontally extending flange portions.

In one example, the vertically oriented wall portion, the plurality of horizontally extending flange portions, and the bottom horizontally extending flange portion are formed from a continuous piece of material.

In one example, the plurality of horizontally extending flange portions and the bottom horizontally extending flange portion extend from a same side of the vertically oriented wall portion such that the bottom horizontally extending flange portion, vertically oriented flange portion, and the plurality of horizontally extending flange portions form a C-shaped cross-sectional profile.

In one example, the first adjustable length support arm includes an intermediate arm member mechanically interposed between the first and second arm members. The intermediate arm member is movable relative to the first arm member parallel to the sliding axis and is movable relative to the second arm member parallel to the sliding axis such that the first arm member, second arm member and intermediate arm members are telescopically movable relative to one another when transitioning from the retracted position to the extended position.

In one example, the first arm member includes a first slide member and a first support member. The first slide member is fixed to the first support member such that the first slide member does not move relative to the first support member when transitioning between the retracted and extended positions. The second arm member includes a second slide member and a second support member. The second slide member is fixed to the second support member such that the second slide member does not move relative to the second support member when transitioning between the retracted and extended positions. The shelf is affixed to the second support member.

In one example, the first arm member includes a first slide member and a first support member. The first slide member is fixed to the first support member such that the first slide member does not move relative to the first support member when transitioning between the retracted and extended positions. The second arm member includes a second slide member and a second support member. The second slide member is fixed to the second support member such that the second slide member does not move relative to the second support member when transitioning between the retracted and extended positions. The shelf is affixed to the second support member. The intermediate portion is a third slide member interposed between the first and second slide members. A first set of sliding elements is located between the third slide member and the first slide member to facilitate movement between the first and second slide members. A second set of sliding elements is located between the third slide member and the second slide member to facilitate movement between the first and second slide members.

In one example, the first set of sliding elements is a first plurality of ball bearings and the second set of sliding elements is a second plurality of ball bearings.

In one example, the first set of sliding elements is provided by at least one first roller and the second set of sliding elements is provided by at least one second roller. As such as used herein, a set may be made of a single component.

In one example, the first and second catches are not provided by the first slide member and are provided by the first support member.

In one example, the first arm member has a first vertically oriented wall portion and a laterally inward extending first flange arrangement that provides the first and second catches. The first flange arrangement extends inward of the vertically oriented wall portion. The first flange arrangement has an inner edge. The second arm member has a second vertically oriented wall portion and a laterally outward extending second flange arrangement that extends outward of the vertically oriented wall portion. The second flange arrangement has an outer edge. The first and second flange arrangements overlap one another with the inner edge positioned between the second vertically oriented wall portion and the outer edge.

In one example, the shelf is attached to the second flange arrangement.

In one example, the pivot link is pivotally attached to and carried by the shelf.

In one example, the handle is operably connected to the pivot link with at least two degrees of freedom therebetween with at least one of the degrees of freedom providing pivoting motion between the handle and the pivot link. The latch bolt is operably connected to the pivot link with at least two degrees of freedom therebetween with at least one of the degrees of freedom providing pivoting motion between the latch bolt.

In one example, the second degree of freedom between the handle and pivot link prevents or limits the pivot link from moving the handle towards or away from the first adjustable length support arm when the pivot link is rotated about the pivot axis. The second degree of freedom between the latch bolt and pivot link prevents or limits the pivot link from moving the latch bolt towards or away from front and rear sides of the shelf when the pivot link is rotated about the pivot axis.

In one example, the latch arrangement includes a latch bolt carrier defining a trough. The latch bolt carrier is mounted to an underside of the shelf. The latch bolt is slidably carried within the trough between the latch bolt carrier and the underside of the shelf.

In one example, the first abutment surface is more orthogonal to the sliding axis than the second abutment surface.

In one example, at least one of the first and second cams extends at an angle that is at least 15 degrees from being perpendicular to the sliding axis.

In one example, the sliding axis is generally perpendicular to the front and back sides.

In one example, a second adjustable length arm is proximate the second side of the shelf and is spaced apart from the first adjustable length arm. The second adjustable length arm is substantially identical to the first adjustable length arm.

In one example, the second adjustable length arm is a mirror image of the first adjustable length arm.

In one example, the shelf includes frame work and a product support panel mounted to the frame work. The frame work includes at least one notch. The notch slidably receives the handle therein.

In an example, a retail merchandise display system including a vertical support member and a pullout shelf as outlined above is provided. The pullout shelf assembly is attached to the vertical support member in a cantilevered orientation. The shelf is positioned farther from the vertical support member when in the first extended position than in the retracted position.

In one example, the vertical support member includes a first gondola upright has a plurality of spaced apart mounting apertures in a front face thereof. The first adjustable length arm is attached to the first gondola upright with a hook member of the first arm member inserted in one of the plurality of spaced apart mounting apertures.

In an example, a pullout shelf assembly for a retail merchandise display system includes a shelf, a first adjustable length support arm, and a latch arrangement. The shelf has a product support surface extending between a front side and a rear side and between spaced apart first and second lateral sides extending between the front and rear side. The first adjustable length support arm is proximate the first side. The first adjustable length support arm has a first arm member and a second arm member. The second arm member is movable relative to the first arm member parallel to a sliding axis between a retracted position and a first extended position. The shelf is operably attached to the second arm member to move with the second arm member when the second arm member is moved between the retracted and first extended positions. The latch arrangement has a first catch associated with and having a fixed position relative to the first arm member establishing the retracted position. The latch arrangement has a latch bolt selectively engageable with and disengageable from the first catch. The latch bolt secures the second arm member in the retracted position when engaged with the first catch. A handle is operably attached to the latch bolt to actuate the latch bolt out of engagement with the first catch when in the retracted position to permit movement of the second arm member relative to the first arm member.

In one example, the latch bolt and handle are operably carried by the shelf such that the latch bolt and handle move with the shelf when the second arm member is moved relative to the first arm member.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
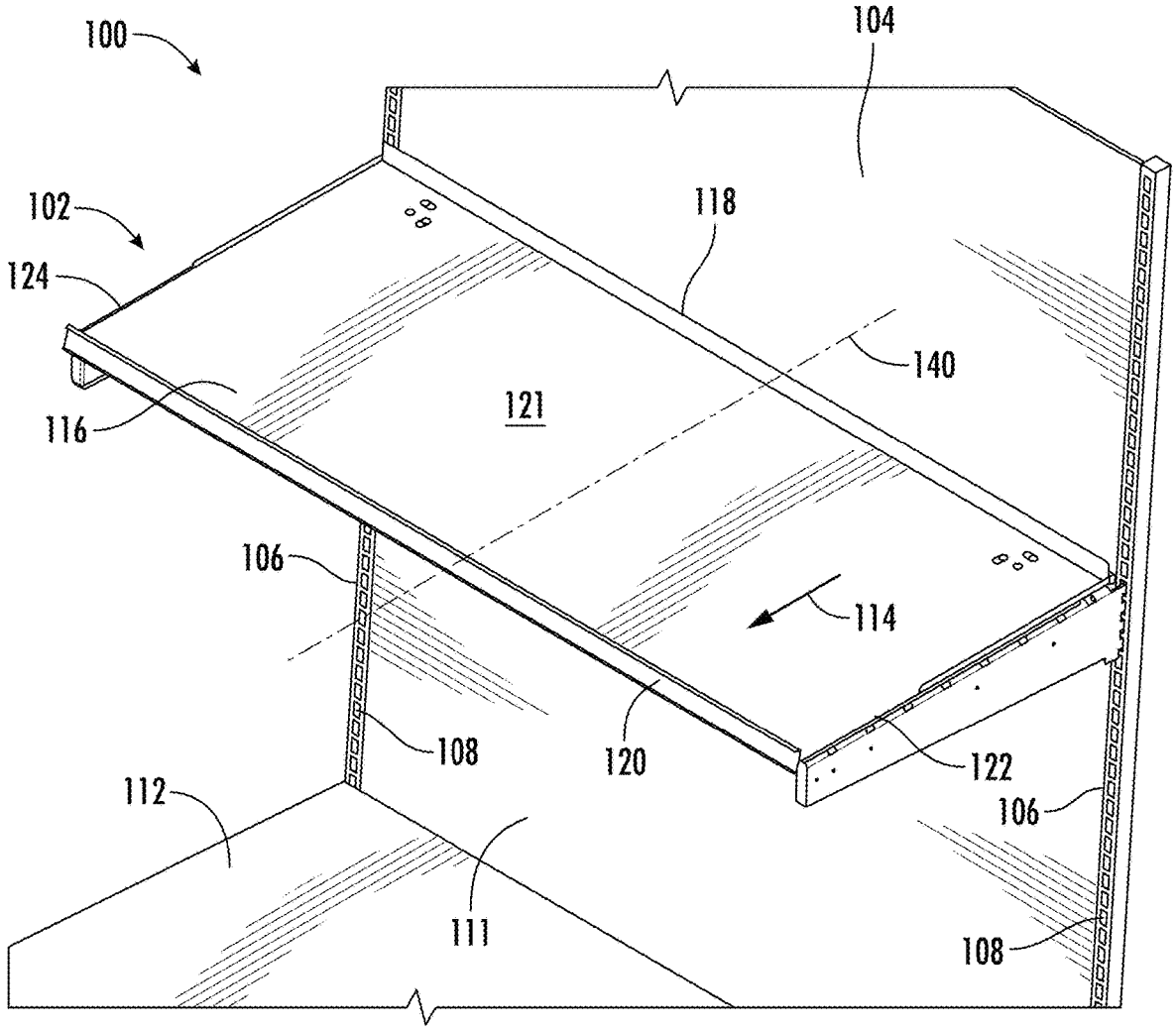
FIG. 1 is a partial perspective illustration of a retail merchandise display system.

FIG. 1 illustrates a retail merchandise display system 100 including a pullout shelf assembly 102 mounted to a vertical support structure 104, which takes the form of a gondola support structure in this example. While only a single shelf 102 is illustrated, typically, but not always, multiple shelves will be mounted to the support structure in a vertically spaced orientation.

Figure 2:
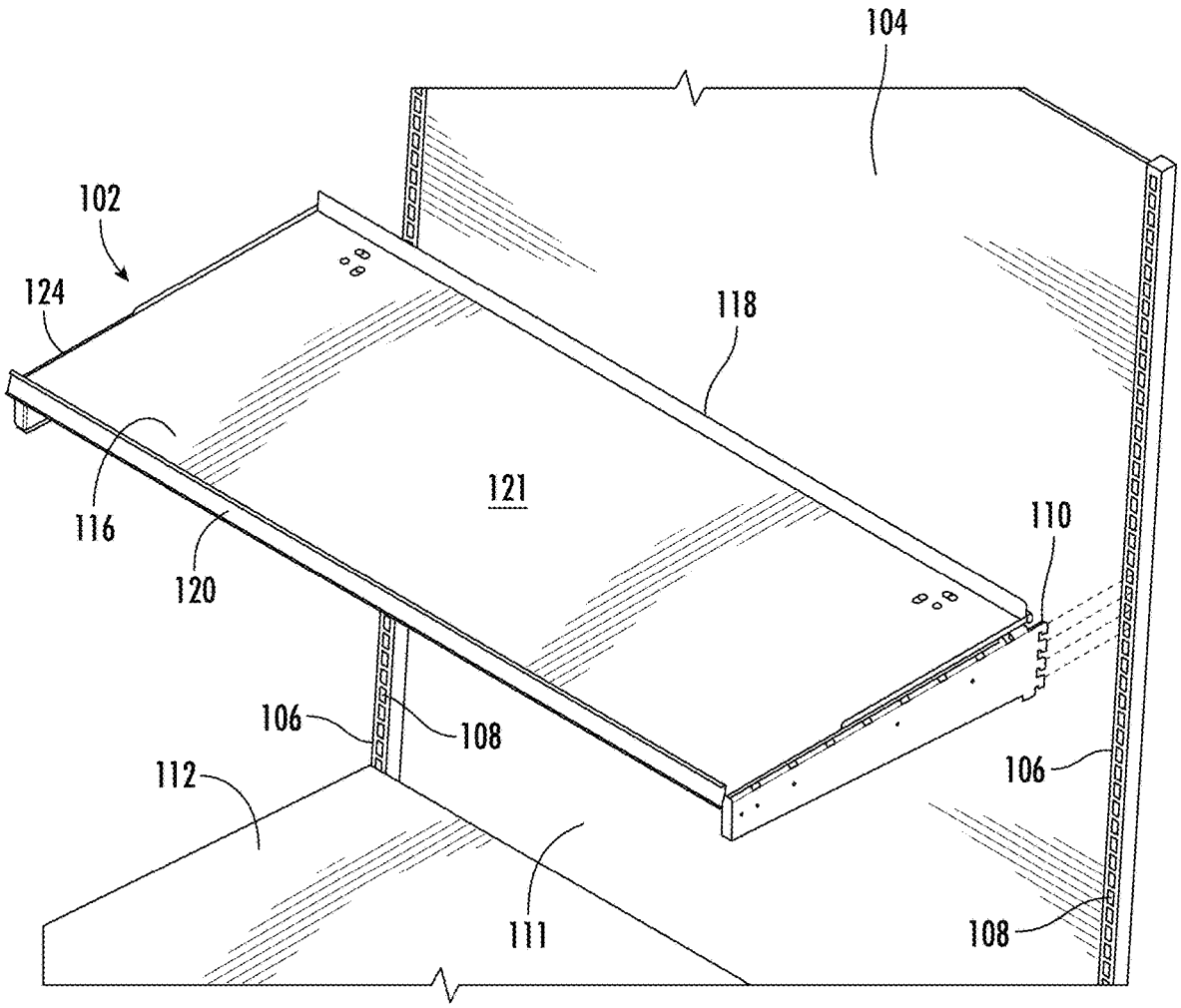
FIG. 2 is a partial perspective illustration of the retail merchandise display system of FIG. 1 with the shelf assembly removed from the vertical support structure.

The upright support structure 104 includes a pair of spaced apart upright supports 106 each of which includes a plurality of mounting apertures 108 arranged in a vertically spaced orientation. The mounting apertures 108 are formed in a front face of the upright supports 106 and receive mounting hooks 110 (see FIG. 2) of the shelf assembly 102 to mount the shelf assembly 102 in a cantilevered orientation. However, other mounting arrangements are contemplated. For example, bolts or screws could be used to secure the shelf assembly to the upright support structure 104. In some examples, the shelf assembly could be welded to the upright support structure 104.

The upright support structure 104 may include a back wall 111 that extends laterally between the spaced apart upright supports 106. The illustrated example is a stand along system and includes a base 112 that may rest on the flow of the retail establishment. The back wall 111 and upright supports 106 extend vertically upward from the base 112. In other examples, the back wall 111 may be omitted. Further, in other examples, the upright supports 106 could be mounted directly to a vertical wall of the building forming the retail establishment such that no base 112 is required.

Figure 3:
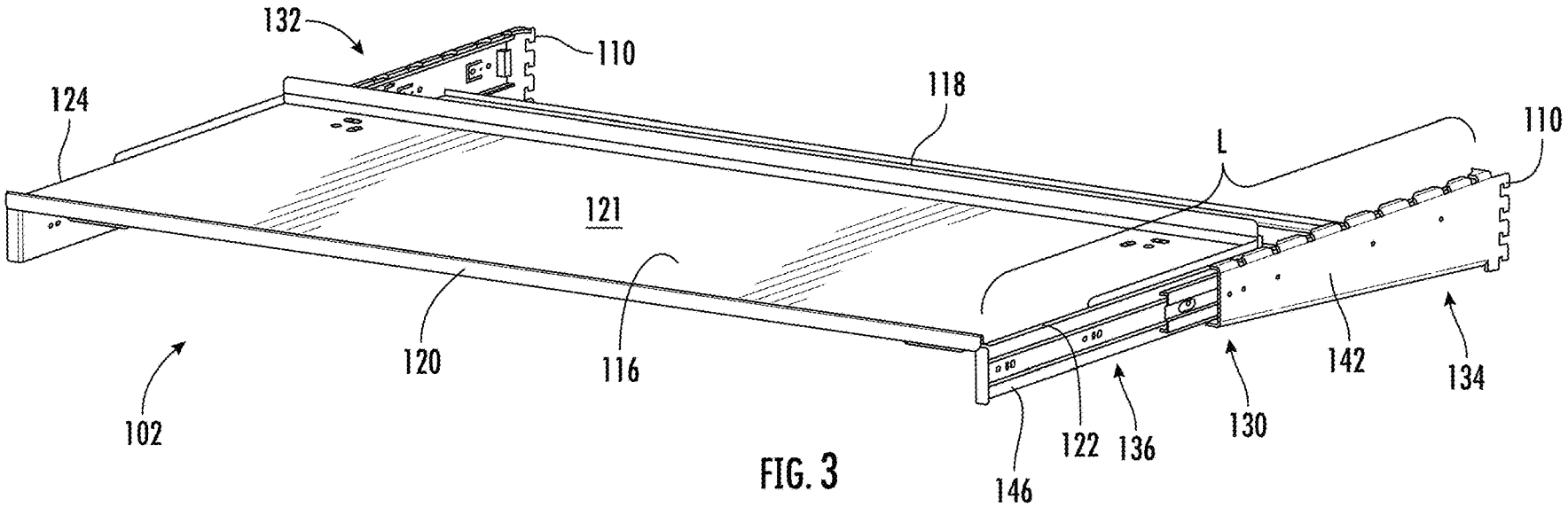
FIG. 3 is a perspective illustration of the shelf assembly of the retail merchandise display system in an extended orientation.

The shelf assembly 102 is configured to transition between a retracted orientation as illustrated in FIG. 1 to one or more extended orientations as illustrated in FIG. 3. In particular, a user may selectively pullout a shelf 116 of the shelf assembly 102 so as to provide improved access to merchandise stored proximate a rear side 118 of the shelf 116. This motion is represented schematically as arrow 114 in FIG. 1. In the retracted orientation, the shelf 116 is closer to the upright support structure 104 than in the extended orientation(s).

The shelf 116 generally includes rear side 118, front side 120, and spaced apart lateral sides 122, 124. The shelf 116 in this example is generally rectangular such that rear and front sides 118, 120 are generally parallel to one another. Lateral sides 122, 124 are generally parallel to one another and generally perpendicular to rear and front sides 118, 120.

The shelf 116 generally defines a product support surface 121 upon which merchandise is stored. The product support surface 121 is typically a vertically upper side of the shelf 116.

The shelf 116 is operably attached to a pair of spaced apart adjustable length support arms 130, 132 (see e.g. length L) in FIG. 3). The length L of the arms 130, 132 changes when transitioning between the retracted orientation (FIG. 1) and the extended orientation (FIG. 3) to transition the shelf 116 between a retracted position (FIG. 1) to an extended position (FIG. 3). One arm 130 is attached proximate lateral side 122 and the other arm 132 is attached proximate lateral side 124.

The adjustable length support arms 130, 132 are substantially identical to one another and thus only one will be described.

With reference to FIGS. 4-8, adjustable length support arm 130 will be described.

In the illustrated example, the adjustable length support arm 130 includes first, second and third arm members 134, 136, 138. The arm members 134, 136, 138 are movable relative to one another to adjust the length L of adjustable length support arm 130. In particular, the arm members 134, 136, 138 are generally movable relative to one another parallel to a sliding axis 140 (see FIG. 1). In this example, sliding axis 140 is generally parallel to lateral sides 122, 124 of shelf 116 and generally extends between the front and rear sides 120, 118.

The first arm member 134 moves relative to the second arm member 136 between a retracted position (see e.g. FIG. 1) and one or more extended positions (see e.g. FIG. 3). In the retracted position, the length of the adjustable length support arm 130 is less than in the extended position.

Figure 4:
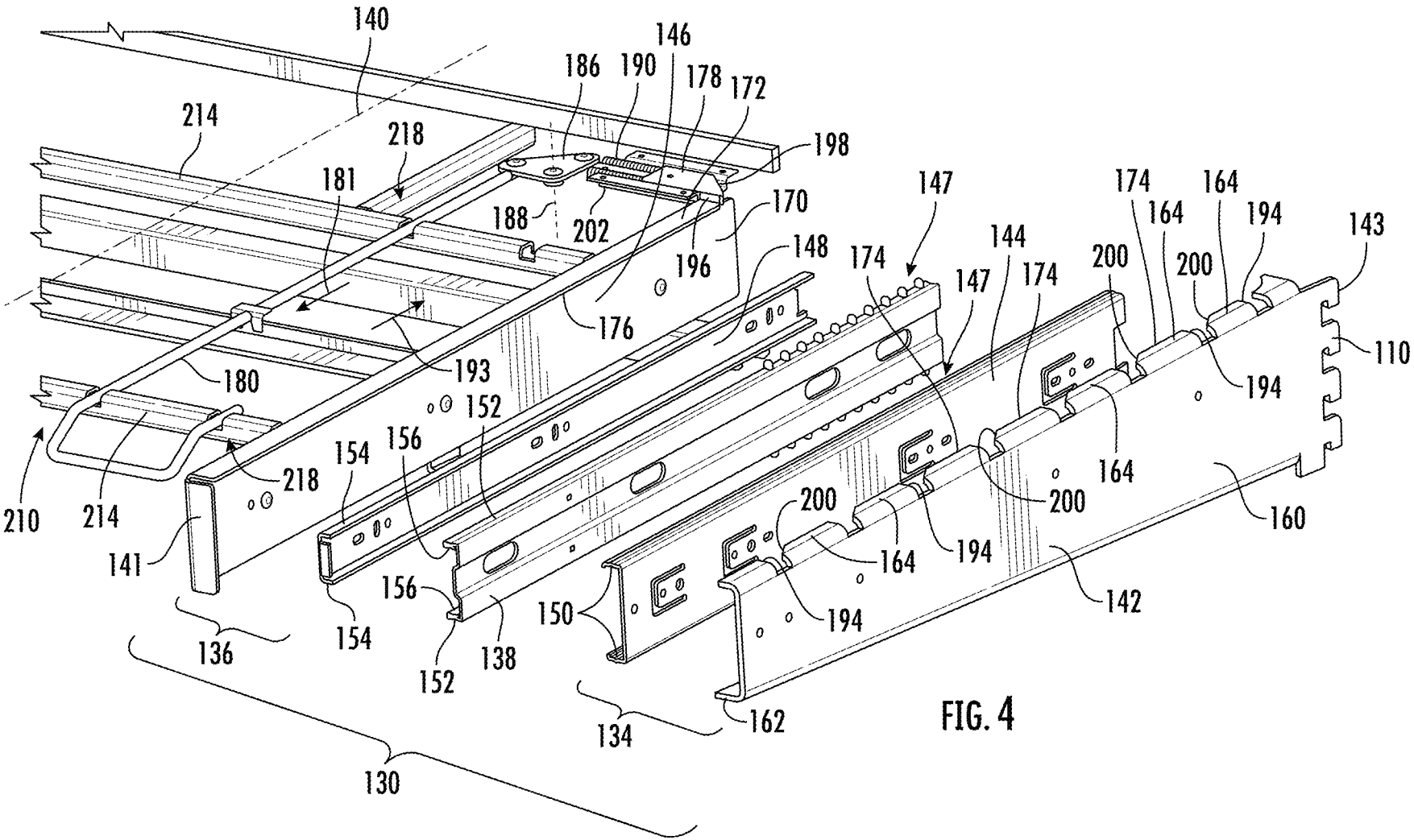
FIGS. 4-7 are partial exploded perspective illustrations of the shelf assembly.
Figure 5:
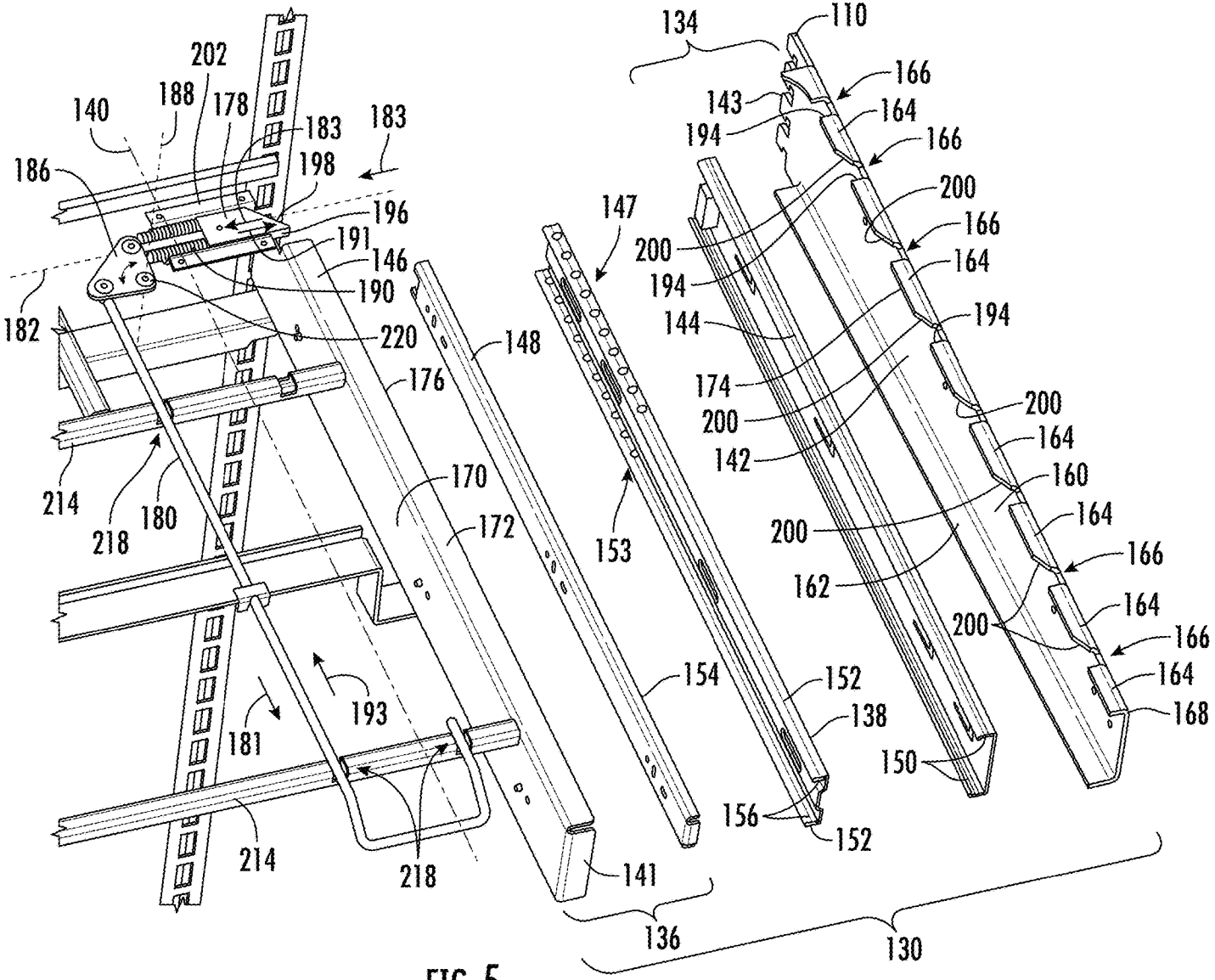
Figure 6:
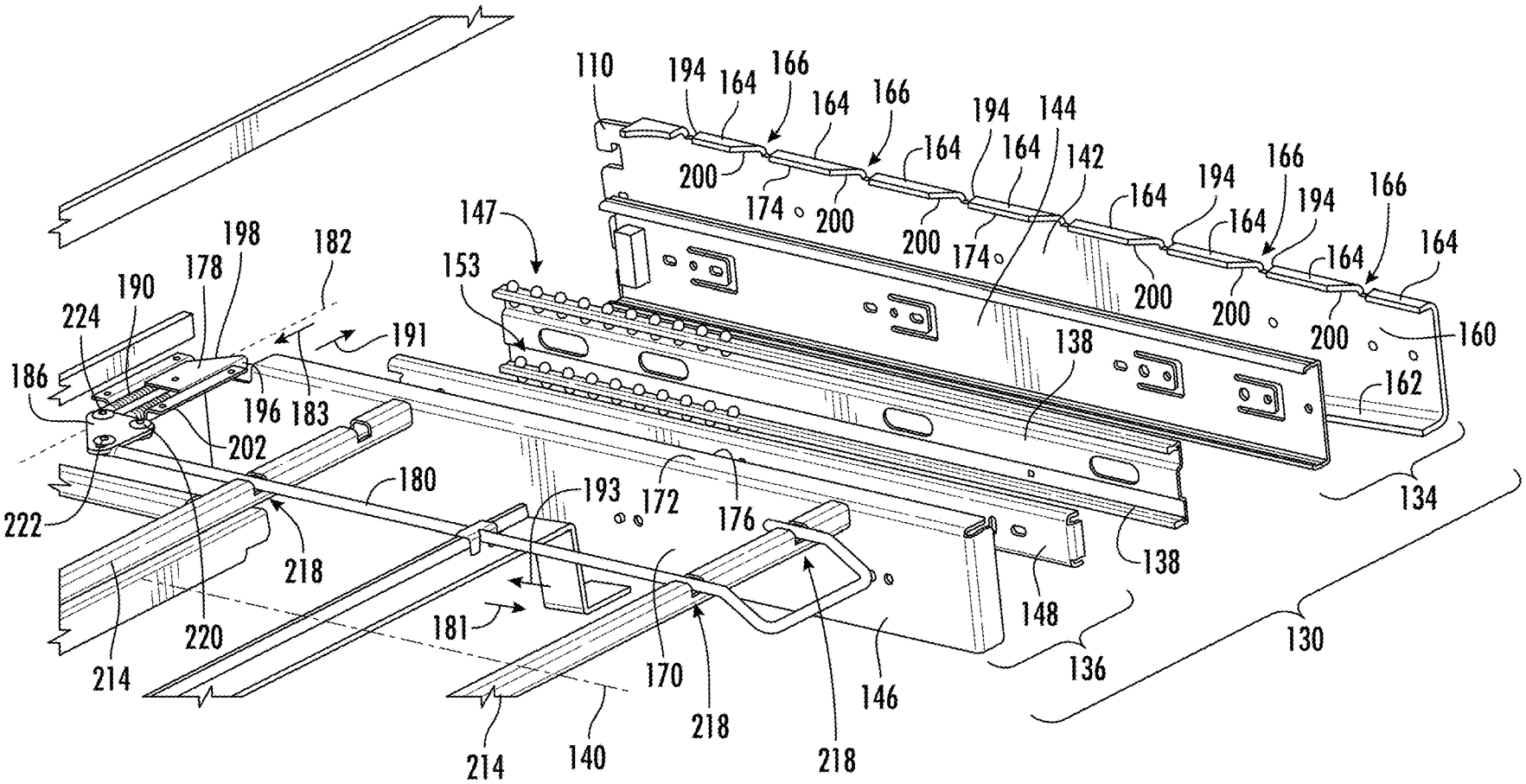
Figure 7:
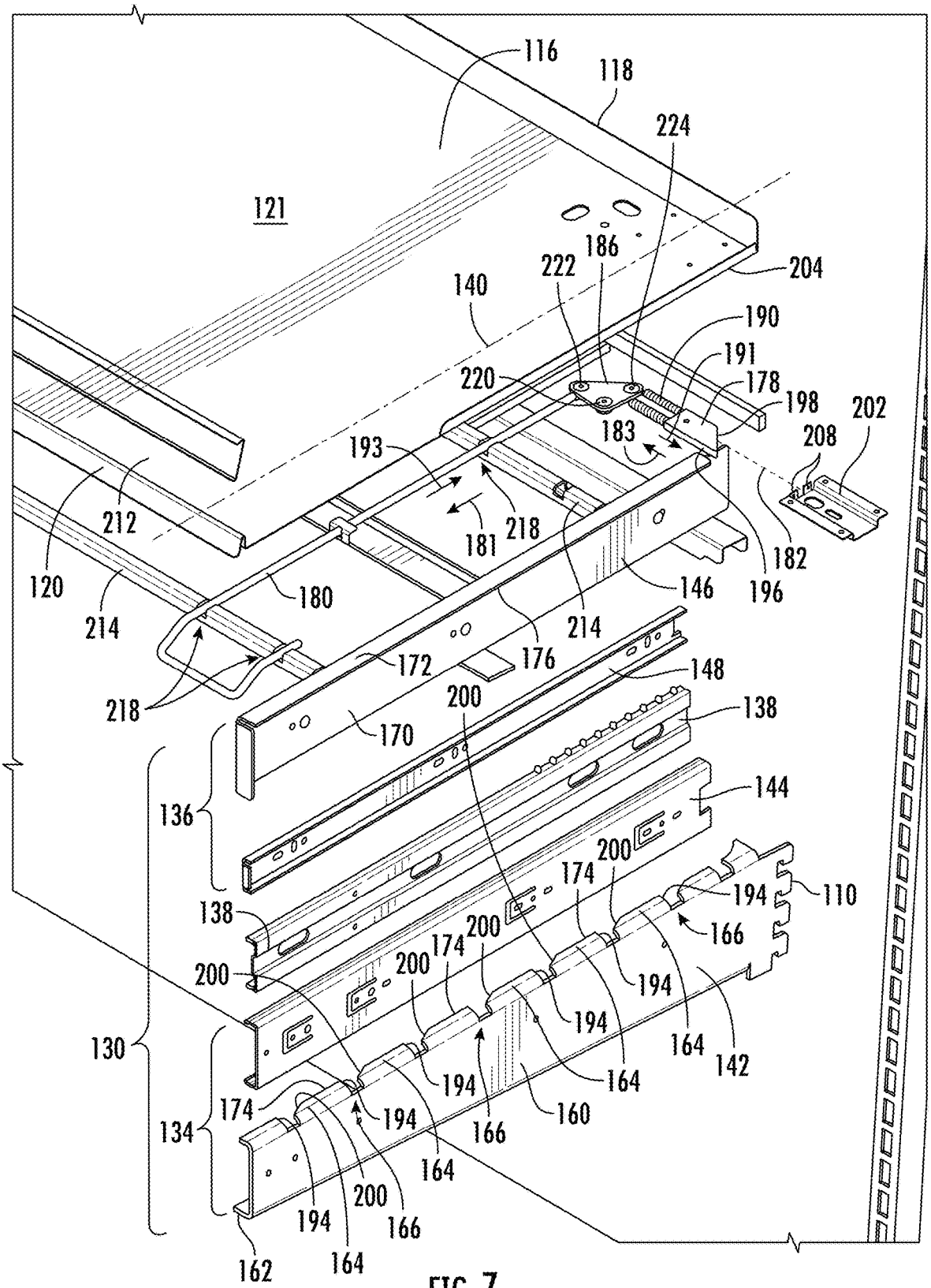
Figure 8:
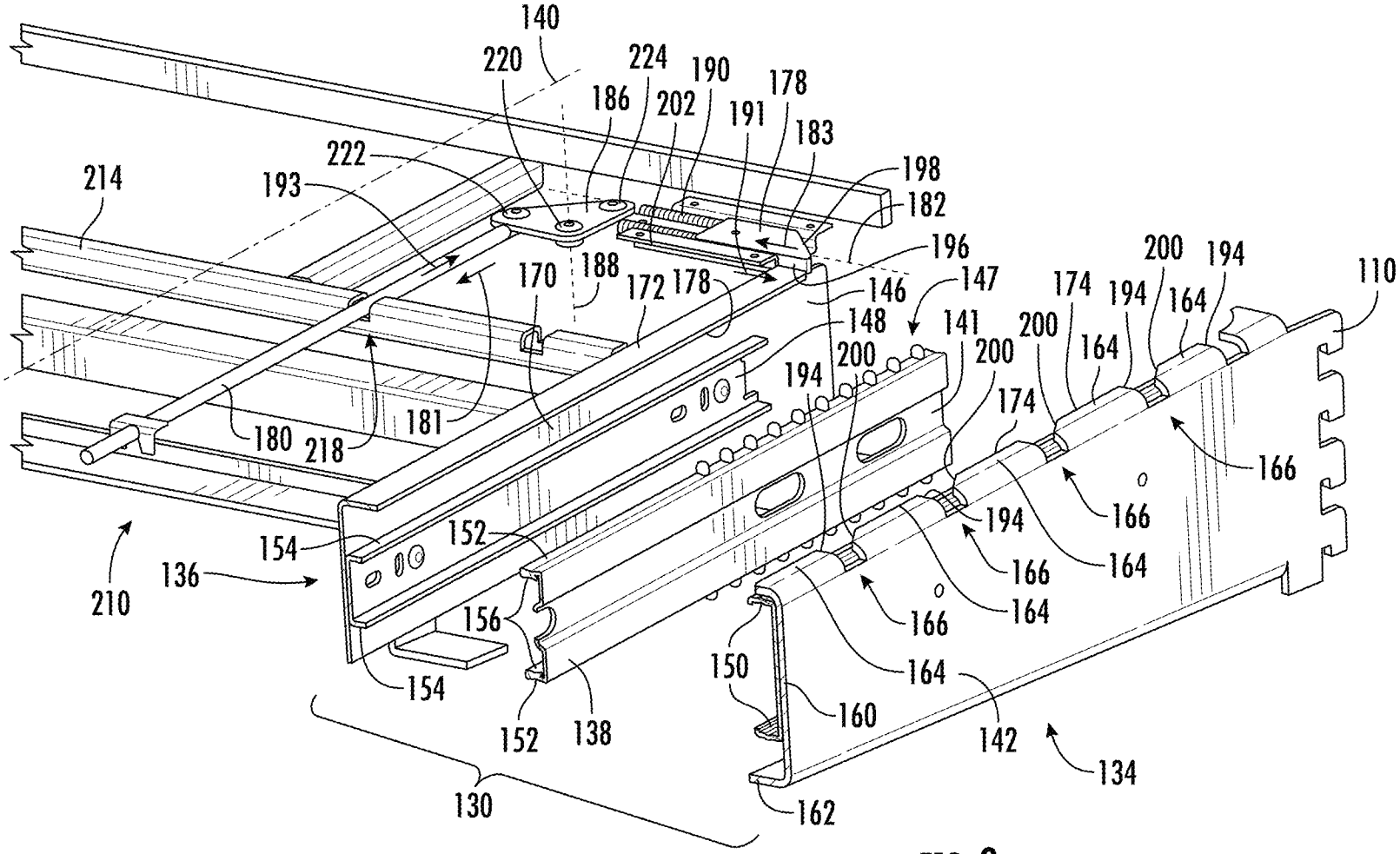
FIG. 8 is a cross-sectional partial exploded perspective illustration of the shelf assembly.

With reference to FIG. 4, a front end 141 of adjustable length support arm 130 is provided by second arm member 136 and a rear end 143 of adjustable length support arm 130 is provided by first arm member 134.

In this example, the first arm member 134 is a composite structure provided by a first support member 142 and a first slide member 144. The first slide member 144 is attached to the first support member 142 such that in operation the first slide member 144 does not move relative to the first support member 142. This could be done by way of mechanical attachment such as screws, bolts, rivets or mechanical interlock between the first support member 142 and first slide member 144.

In this example, the second arm member 136 is a composite structure provided by a second support member 146 and a second slide member 148. The second slide member 148 is attached to the second support member 146 such that in operation the second slide member 148 does not move relative to the second support member 146. This could be done by way of mechanical attachment such as screws, bolts, rivets or mechanical interlock between the first support member 146 and first slide member 148.

The third arm member 138 is in the form of a third slide member. Third arm member 138 may be referred to herein as third slide member 138.

With reference to FIGS. 4-9, a first sliding element in the form of a first set of bearing balls 147 are located between a first set of race ways 150 of the first slide member 144 and a second set of race ways 152 of the third slide member 138. The first set of race ways 150 face away from one another while the second set of race ways 152 face towards each other. The first set of bearing balls 147 allow the first and third slide members 144, 138 to move axially relative to one another.

A second sliding element in the form of a second set of bearing balls 153 are located between a third set of raceways 154 of the second slide member 148 and a fourth set of race ways 156 of the third slide member 138. The third set of race ways 154 face away from one another while the fourth set of race ways 156 face one another. The second set of bearing balls 153 allow the second and third slide members 148, 138 to move axially relative to one another. This also allows the second slide member 148 to move axially relative to the first slide member 144.

The telescopic sliding relationship between the first, second and third sliding members 144, 148, 138 allows for adjusting the axial length (e.g. parallel to the sliding axis 140) of the first adjustable length support arm 130.

While the illustrated embodiment utilizes ball bearings as the sliding elements between the sliding members 144, 148, 138, in other examples other sliding elements could be used such as one or more rollers. Alternatively, the sliding elements could simply be sliding surfaces and preferably low friction sliding surfaces.

The first support member 142 is elongated parallel to the sliding axis 140. The first support member 142 has a generally C-shaped cross-section when viewed along the sliding axis 142 provided by a vertically oriented wall portion 160, a bottom horizontally extending flange portion 162 and a plurality of horizontally extending flange portions 164. The plurality of horizontally extending flange portions 164 are axially spaced apart parallel to the sliding axis 140 forming gaps 166 between adjacent pares of flange portions 164.

In this example, the vertically oriented wall portion 160, bottom horizontally extending flange portion 162 and the plurality of horizontally extending flange portions 164 are formed from a single continuous piece of material. Optionally, and as illustrated in the example, the mounting hooks 110 at the rear end 144 are also formed as a continuous piece of material with the vertically oriented wall portion 160, horizontally extending flange portion 162 and plurality of horizontally extending flange portions 164.

The vertically oriented wall portion 160 extends vertically between the bottom horizontally extending flange portion 162 and the plurality of horizontally extending flange portions 164. In the illustrated embodiment, the bottom horizontally extending flange portion 162 and the plurality of horizontally extending flange portions 164 extend from a same side of the vertically oriented wall portion 160. This provides the C-shaped cross-section. In this example, the side is an inner side of the vertically oriented wall portion 160 such that the flange portions 162, 164 extend inward.

In this example, when moving from the front end toward the rear end, the height of the vertically oriented wall portion 160, and consequently the first support member 142, increases.

In this example, the horizontally extending flange portions form or are proximate a top portion of the first support member 142. In this example, the horizontally extending flange portions 164 include a vertical portion such that the horizontal portion thereof is vertically offset from the vertically oriented wall portion 160. A bend 168 connects the horizontal portion to the vertical portion thereof.

Figure 9:
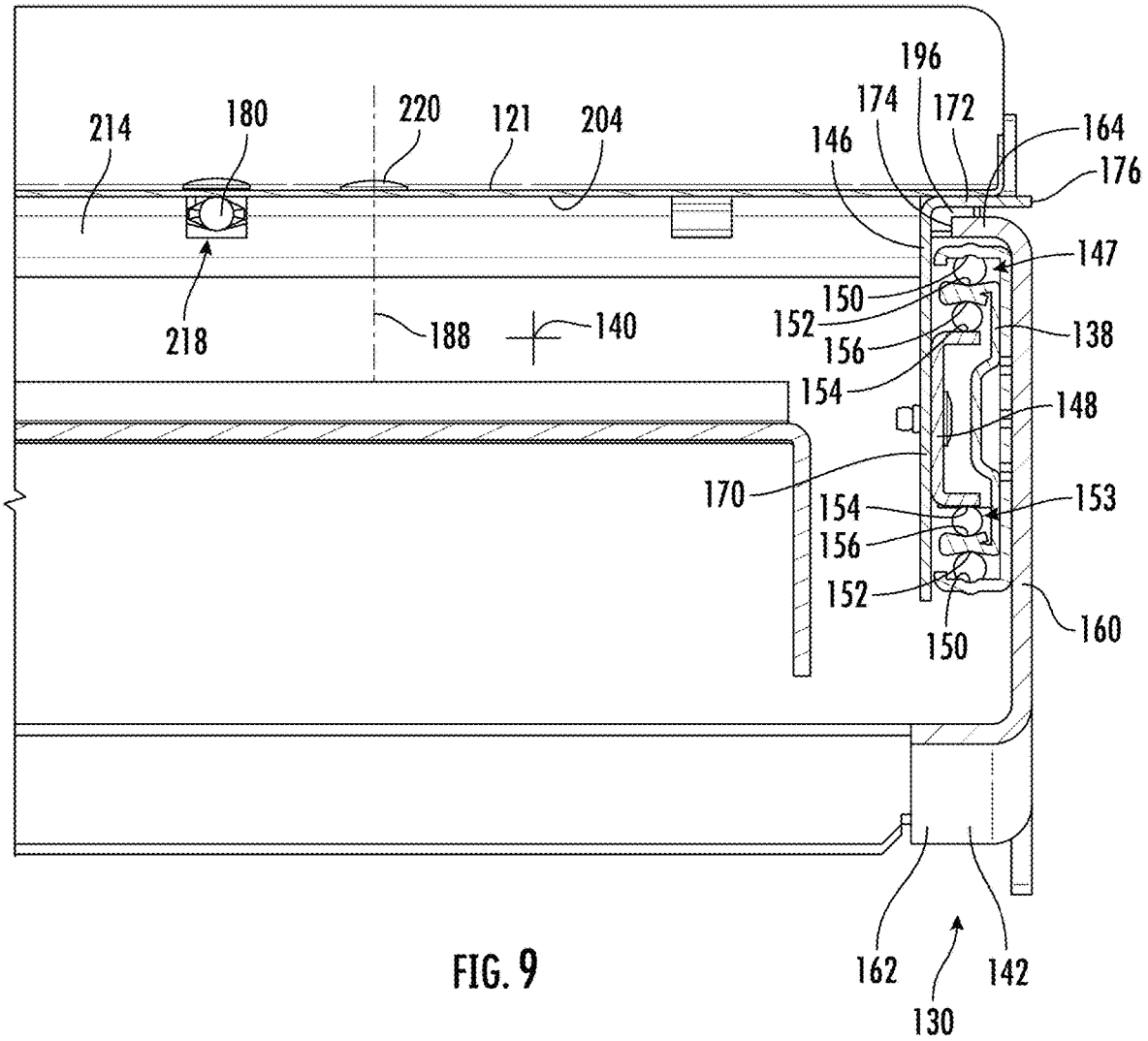
FIG. 9 is a partial cross-sectional illustration of the shelf assembly.
Figure 10:
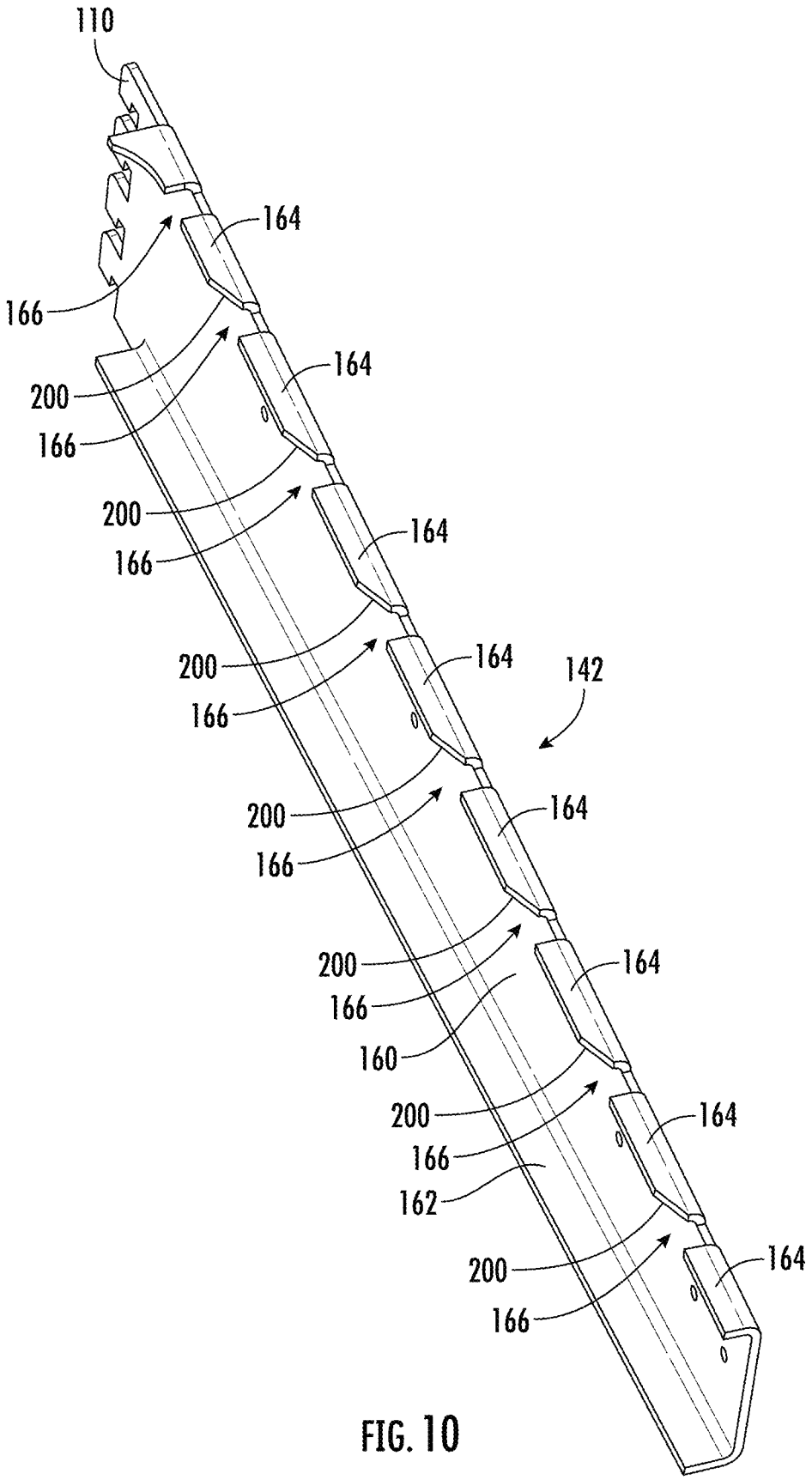
FIG. 10 is a perspective illustration of a support member of one of the adjustable length support arms of the shelf assembly.

With reference to FIGS. 4 and 9, the second support member 146 has a vertically oriented wall portion 170 and a horizontally extending flange portion 172. The horizontally extending flange portion 172 extends outward from the vertically oriented wall portion 170. When assembled, the horizontally extending flange portion 172 extends outward and over at least some of the plurality of horizontally extending flange portions 164. In particular, the horizontally extending flange portions 164 have inner edges 174 and the horizontally extending flange portion 172 has an outer edge 176. The inner edges 174 are positioned horizontally between the outer edge 176 and the vertically oriented wall portion 170.

The shelf 116 is operably attached to the second support member 146 such that the shelf 116 moves with the second arm member 136 when the second arm member 136 transitions between the retracted and the extended position(s) relative to the first arm member 134.

In the illustrated example, the shelf 116 is secured to the top of the second support member 146 of the second arm member 136 and particularly to horizontally extending flange portion 172. This connection could be by screws, bolts, rivets, adhesives, welding, mechanical interconnection, etc.

A latch arrangement acts between the shelf 116 and the first arm member 134 and particularly the first support member 142 thereof to secure the shelf 116 in one or more extended positions relative to the first arm member 134.

The latch arrangement includes a latch bolt 178 that cooperates with a plurality of catches to secure the second arm member 136 relative to the first arm member 134 in the retracted and one or more extended positions. In this example, the gaps 166 provide the catches. The gap 166 closest the rear end 143 of the first arm member 134 defines the retracted position and the other gaps 166 define extended positions.

The latch bolt 178 is selectively engageable with the catches to secure the shelf 116 and the second arm member 136 to the first arm member 134 to prevent axial motion along sliding axis 140. The latch bolt 178 may be disengaged from the catches to permit the shelf 116 and second arm member 136 to move relative to the first arm member 134.

A handle 180 is operably coupled to the latch bolt 178. Actuation of handle 180 actuates latch bolt 178. More particularly, when a user applies an external force to the handle 180 such as by pulling on the handle, e.g. by applying a force acting away from the rear end 118, the actuation of handle 180 actuates the latch bolt 178 out of engagement with the catches (e.g. gaps 166). This permits the shelf 116 to slide along the sliding axis 140 between the various axial positions defined by the catches.

In this example, the handle 180 is actuated by the user generally parallel to sliding axis 140. Further, when a user pulls on handle 180 in a direction extending away from the rear side 118 and toward the front side 120 illustrated by arrow 181 the latch bolt 178 is actuated along a latch axis 182 illustrated by arrow 183. Notably, motion of the latch bolt 178, in this example, is generally perpendicular to motion of the handle 180 as the sliding axis 140 is generally perpendicular to the latch axis 182.

A pivot link 186 operably connects the handle 180 to the latch bolt 178. The pivot link 186 pivots about pivot axis 188. Pivot axis 188 is generally perpendicular to sliding axis 140 and latch axis 182. The linear motion of handle 180 in a first direction parallel to sliding axis 140 is converted to angular motion of the pivot link 186 in a first angular direction which then linearly drives the latch bolt 178 in a first direction parallel to latch axis 182 as illustrated by arrow 183.

A biasing member in the form of a pair of coil springs 190 biases the latch bolt 178 towards the engaged position. As such, when the user releases the external force on the handle 180, the coil springs 190 bias the latch bolt 178 in a second direction illustrated by arrow 191 parallel to latch axis 182, opposite the first direction illustrated by arrow 183. This also causes the handle 180 to transition rearward in a second direction parallel to sliding axis 140 illustrated by arrow 193. Additionally, pivot link 186 will rotate in a second angular direction about pivot axis 188.

The rear facing sides 194 of the plurality of horizontally extending flange portions 164 provide abutment surfaces that abut an abutment face 196 of the latch bolt 178. This abutment prevents the shelf 116 from being slid axially outward without first actuating handle 180 (e.g. in the first direction 181). In a preferred example, sides 194 and face 196 are substantially perpendicular to one another to inhibit biasing the latch bolt 178 out of gap 166 by an external force being applied to shelf 116 in the first direction 181 parallel to sliding axis 140. In some embodiments, sides 194 and/or face 196 may have a slight taper that if a force in the first direction 181 is applied it biases the latch bolt laterally outward and into gaps 166 (e.g. in the second direction 193 parallel to latch axis 182). This prevents the shelf 116 from being actuated forward without actuating handle 180.

However, to facilitate more easily transitioning the shelf 116 from one of the extended positions to more retracted positions or the rear most retracted position, a cam arrangement may be provided between the latch bolt 178 and the catches. In this example, a rear side 198 of the latch bolt 178 is tapered as is a forward facing side 200 of the horizontally extending flange portions 164. The tapered arrangement provides an auto disengaging feature. As such, if a user applies a sufficient predetermined force in the second direction 193 parallel to sliding axis 140 to shelf 116, the taper will convert the force to a force parallel to the latch axis 182 in the first direction 183 to actuate the latch bolt 178 in the first direction 183 parallel to the latch axis 182. This will drive the latch bolt 178 out of the corresponding gap 166 to disengage the latch bolt 178 from the first arm member 134 and allow motion between the shelf 116 and the first arm member 134 in the rearward second direction (e.g. illustrated by arrow 193). Thus, a user need not actuate handle 180 to return the shelf 116 to or towards the retracted position.

In one example, the tapered sides 198, 200 have an angle of at least 15 degrees from perpendicular to the sliding axis 140. Tapered sides 198, 200 extend inward when moving rearward.

Notably, only one of the rear side 198 or the forward facing sides 200 need have the taper. Further, the retracted most gap 166 does not have any such taper as the shelf 116 can be transitioned rearward no farther.

In this example, the latch bolt 178 is located within a latch bolt carrier 202 that is attached to an underside 204 of shelf 116. The latch bolt carrier defines a trough in which the latch bolt 178 is located. The latch bolt 178 is slidable relative to the shelf 116 and the latch bolt carrier 202 along latch axis 182.

Figure 11:
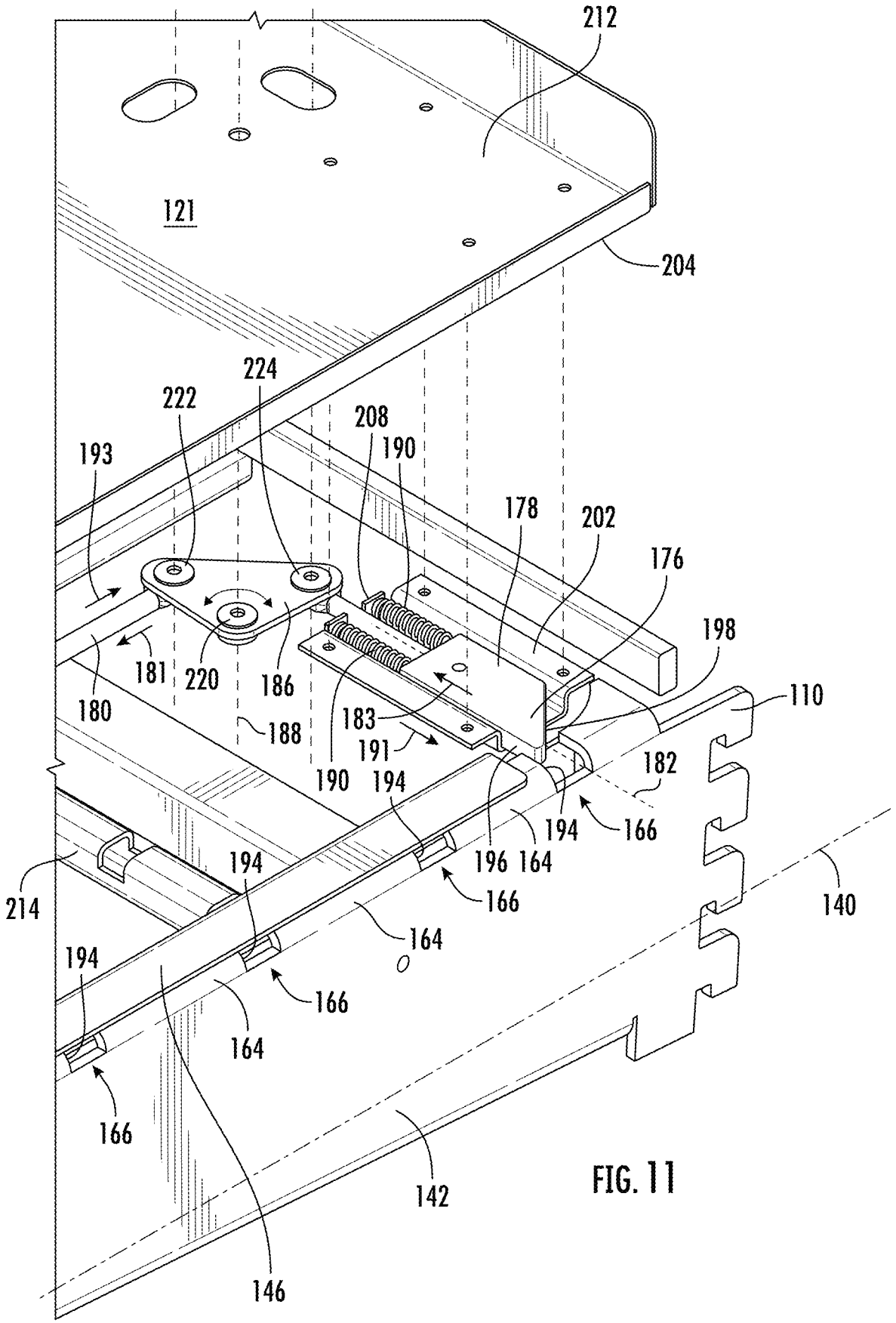
FIGS. 11 and 12 are partial exploded perspective illustrations of the shelf assembly.

With reference to FIG. 11, the latch bolt carrier 202 has abutment flanges 208 against which the coil springs 190 axially abut. The coil springs 190 are compressed against the abutment flanges 208 when the latch bolt 178 is in the disengaged position (e.g. removed from gaps 166).

The handle 180, latch bolt 178 and pivot link 186 are operably carried by shelf 116 such that these components move with the shelf 116 when it transitions between the retracted position and the various extended positions.

The shelf 116 includes a frame 210 and a product support panel 212 mounted to the frame 210. The product support panel 212 defines the product support surface. The frame 210 includes a plurality of braces including laterally extending braces 214 that extend between the first and second adjustable length arms 130, 132.

In this example, braces 214 include guide slots 218 through which the handle 180 extends. The guide slots guide handle 180 and permit movement parallel to sliding axis 140.

The pivot link 186 is pivotally attached to product support panel 212 by pivot pin 220. Pivot pin 220 extends through the pivot link 186 and the product support panel 212. Pivot pin 220 can take numerous forms such as a rivet, screw, bolt, etc.

First and second connecting pins 222, 224 pivotally connect the handle 180 and the latch bolt 178, respectively, to the pivot link 186.

Figure 13:
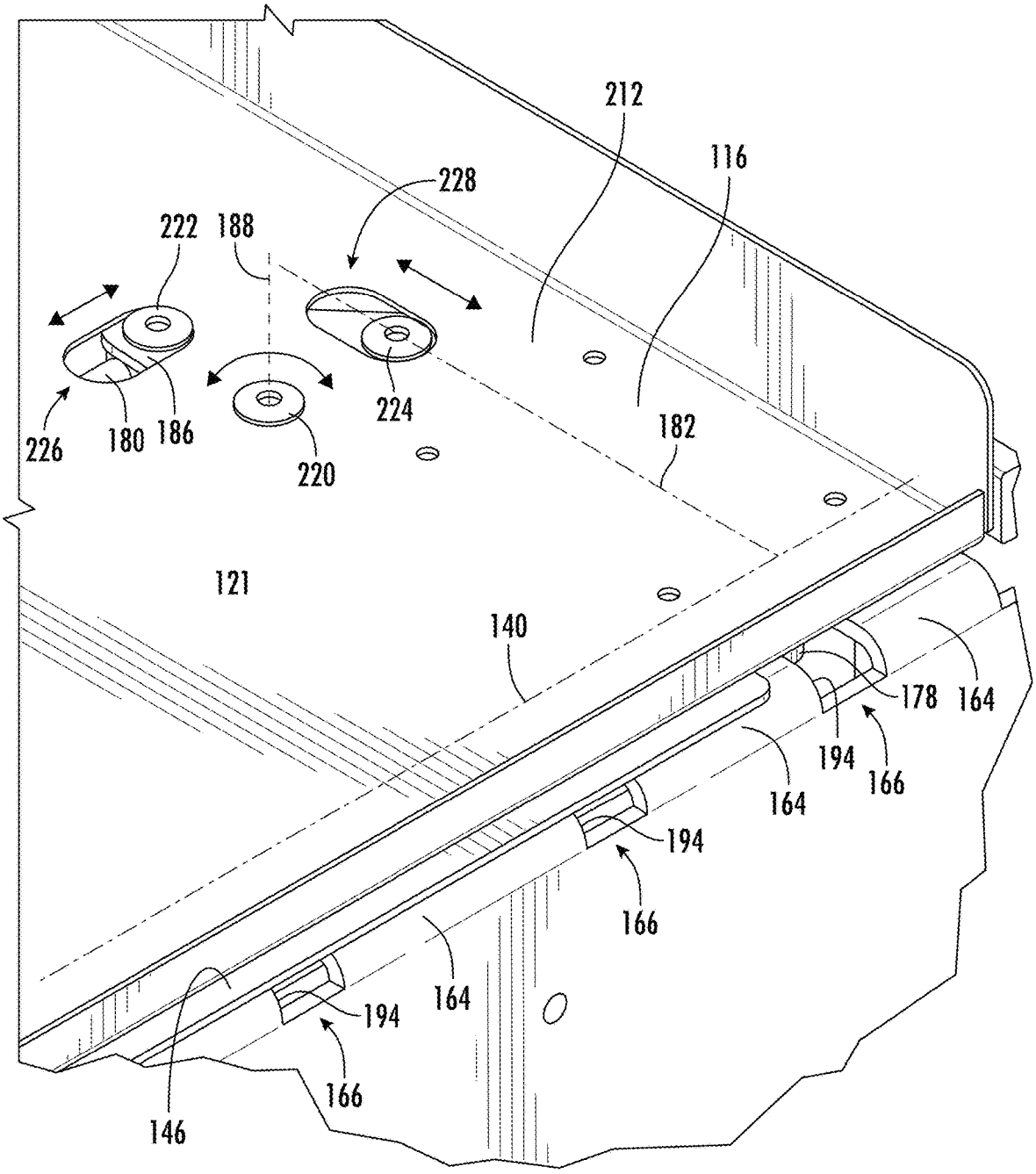
FIG. 13 is an enlarged partial perspective illustration of the shelf assembly.
Figure 14:
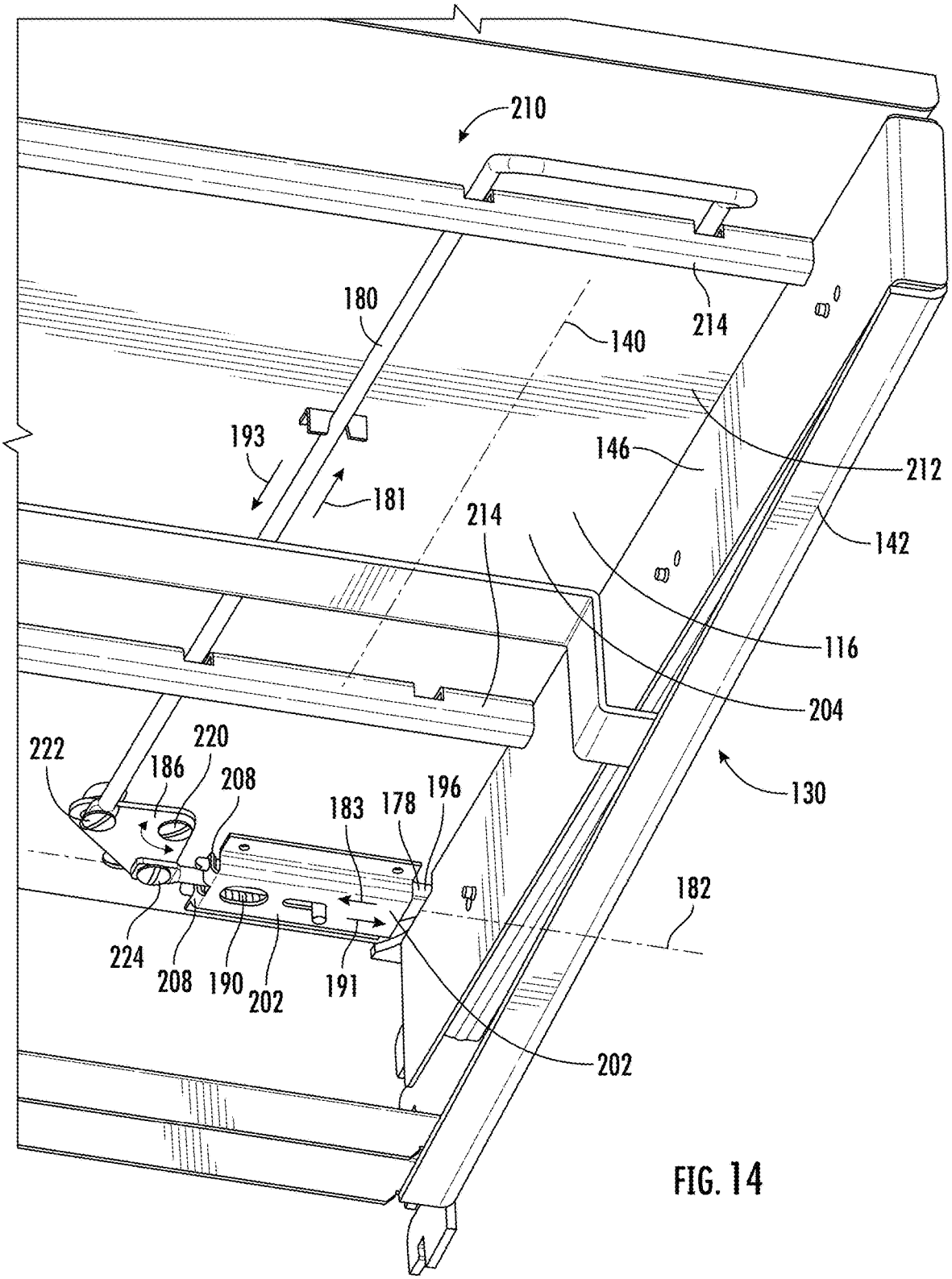
FIG. 14 is a bottom partial perspective illustration of the shelf assembly.

With reference to FIG. 13, product support panel 212 includes first and second slots 226, 228 that receive an upper end of the first and second connecting pins 222, 224 respectively. The connecting pins 222, 224 are permitted to slide axially within slots 226, 228, respectively during actuation of handle 180 and latch bolt 178. Slot 226 is elongated parallel to sliding axis 140 and slot 228 is elongated parallel to latch axis 180.

Figure 12:
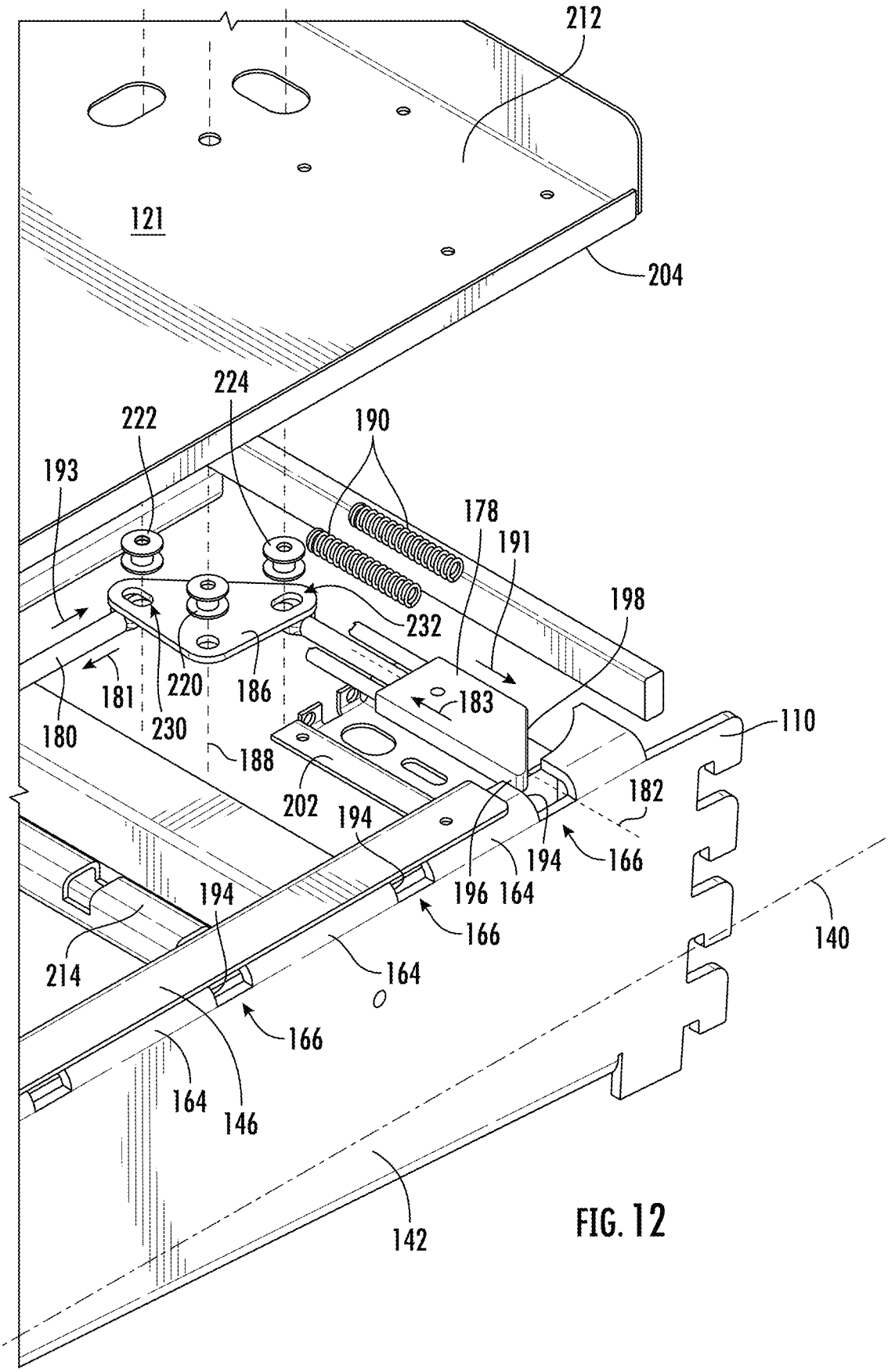

With reference to FIG. 12, to prevent biding of the handle 180 or the latch bolt 178 do to the angular path of connecting pins 222, 224 due to the angular motion of pivot link 186, some degree of clearance is provided within the connection between the handle 180 and pivot link 186 as well as latch bolt 178 and pivot link 186. In this example, the clearance is provided by the apertures 230, 232 in the pivot link 186 that receive connecting pins 222, 224, respectively, are elongated perpendicular to the axis along which the corresponding component slides. More particularly, aperture 230 is elongated perpendicular to sliding axis 140 and aperture 232 is elongated perpendicular to the latch axis 182. Again, this prevents the pivot link 186 from providing a force to the handle 180 or latch bolt 178 that is no parallel to the axis along which each component is configured to move. The elongated nature of apertures 230, 232 provides two degrees of freedom (linear motion and pivoting motion) between the pivot link 186 and the correspondingly attached handle 180 and latch bolt 178.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pullout shelf assembly for a retail merchandise display system comprising:

a shelf having a product support surface extending between a front side and a rear side and between spaced apart first and second lateral sides extending between the front and rear sides;

a first adjustable length support arm proximate the first lateral side, the first adjustable length support arm having:

a first arm member having a top surface and a bottom surface;

a second arm member movable relative to the first arm member parallel to a sliding axis between a retracted position and a first extended position, the shelf being operably attached to the second arm member to move with the second arm member when the second arm member is moved between the retracted position and the first extended position;

a latch arrangement having:

a first catch having a fixed position relative to the first arm member to establish the retracted position, wherein the first catch is a first slot in the top surface of the first arm member;

a second catch having a fixed position relative to the first arm member to establish the first extended position, wherein the second catch is a second slot in the top surface of the first arm member that is spaced apart from the first slot;

a latch bolt selectively engageable with and disengageable from the first and second catches, the latch bolt is configured to secure the second arm member in the retracted position when engaged with the first catch and is configured to secure the second arm member in the first extended position when engaged with the second catch, the latch bolt is configured to secure the first arm member relative to the second arm member when the latch bolt is engaged with either the first or second catches;

a handle operably attached to the latch bolt to actuate the latch bolt out of engagement with the first and second catches when in the retracted and first extended positions, respectively to permit movement of the second arm member relative to the first arm member.

2. The pullout shelf assembly of claim 1, wherein the latch bolt and the handle are configured to be operably carried by the shelf such that the latch bolt and the handle move with the shelf when the second arm member is moved relative to the first arm member.

3. The pullout shelf assembly of claim 1, wherein:

the handle is configured to move parallel to the sliding axis to actuate the latch bolt;

the latch bolt is configured to move relative to the shelf and the first arm member parallel to, at least, a latch bolt axis that is generally perpendicular to the sliding axis when the latch bolt is disengaged from the first and second catches; and the latch assembly further includes a pivot link that is configured to operably connect the handle to the latch bolt, the pivot link configured to pivot about a pivot axis that is generally perpendicular to the sliding axis and the latch bolt axis to convert motion of the handle parallel to the sliding axis into motion of the latch bolt parallel to the latch bolt axis.

4. The pullout shelf assembly of claim 3, wherein, when in use, actuation of the handle in a first direction parallel to the sliding axis pivots the pivot link about the pivot axis in a first angular direction causing the latch bolt to actuate in a second direction parallel to the latch bolt axis to disengage the latch bolt from the first catch when the second arm member is in the retracted position.

5. The pullout shelf assembly of claim 4, wherein, when in use, actuation of the handle in a third direction parallel to the sliding axis pivots the pivot link about the pivot axis in a second angular direction causing the latch bolt to actuate in a fourth direction parallel to the latch bolt axis to engage the latch bolt with the first catch when the second arm member is in the retracted position and with the second catch when the second arm member is in the first extended position.

6. The pullout shelf assembly of claim 1, further including a first cam member fixed relative to the second catch; and wherein the latch bolt has a second cam member that is configured to engage the first cam member, the first and second cam members are configured such that when a predetermined external force is applied to the shelf to move the shelf from the first extended position toward the retracted position with the latch bolt engaged with the second catch, the latch bolt is actuated out of engagement with the second catch such that an external force need not be applied to the handle to disengage the latch bolt and the second catch.

7. The pullout shelf assembly of claim 1, wherein:

the second arm member has a second extended position relative to the first arm member, the second extended position being located between the retracted position and the first extended position;

the latch arrangement has:

a third catch having a fixed position relative to the first arm member to establish the second extended position, the third catch being axially positioned between the first and second catches parallel to the sliding axis wherein the third catch is a third slot in the top surface of the first arm member.

8. The pullout shelf assembly of claim 1, wherein the first arm member includes a mounting hook for mounting the first arm member in a cantilevered orientation to a vertically oriented shelf support, the shelf is configured to move away from the mounting hook when transitioning from the retracted position toward the first extended position.

9. The pullout shelf assembly of claim 1, wherein:

the first arm member extends generally parallel to the sliding axis between a front end and a rear end;

the first arm member includes a vertically oriented wall portion and a plurality of horizontally extending flange portions, the plurality of horizontally extending flange portions extends toward the handle from the vertically oriented wall portion;

a first pair of adjacent ones of the plurality of horizontally extending flange portions defines the first catch therebetween; and a second pair of adjacent ones of the plurality horizontally extending flange portions defines the second catch therebetween.

10. The pullout shelf assembly of claim 1, wherein:

the first adjustable length support arm includes an intermediate arm member operably interposed between the first and second arm members;

the intermediate arm member is movable relative to the first arm member parallel to the sliding axis and is movable relative to the second arm member parallel to the sliding axis such that the first arm member, second arm member and intermediate arm members are telescopically movable relative to one another when transitioning from the retracted position to the extended position.

11. The pullout shelf assembly of claim 1, wherein:

the first arm member includes a first slide member and a first support member, the first slide member is fixed to the first support member such that the first slide member does not move relative to the first support member when transitioning between the retracted and extended positions; and the second arm member includes a second slide member and a second support member, the second slide member is fixed to the second support member such that the second slide member does not move relative to the second support member when transitioning between the retracted and extended positions, the shelf is affixed to the second support member.

12. The pullout shelf assembly of claim 10, wherein:

the first arm member includes a first slide member and a first support member, the first slide member is fixed to the first support member such that the first slide member does not move relative to the first support member when transitioning between the retracted and extended positions;

the second arm member includes a second slide member and a second support member, the second slide member is fixed to the second support member such that the second slide member does not move relative to the second support member when transitioning between the retracted and extended positions, the shelf is affixed to the second support member;

the intermediate portion is a third slide member interposed between the first and second slide members;

a first set of sliding elements is located between the third slide member and the first slide member to facilitate movement between the first and second slide members; and a second set of sliding elements is located between the third slide member and the second slide member to facilitate movement between the first and second slide members.

13. The pullout shelf assembly of claim 11, wherein the first and second catches are not provided by the first slide member and are provided by the first support member.

14. The pullout shelf assembly of claim 3, wherein:

the handle is operably connected to the pivot link with at least two degrees of freedom therebetween with at least one of the degrees of freedom configured to provide a pivoting motion between the handle and the pivot link;

the latch bolt is operably connected to the pivot link with at least two degrees of freedom therebetween with at least one of the degrees of freedom configured to provide a pivoting motion between the latch bolt;

the second degree of freedom between the handle and pivot link is configured to prevent or limit the pivot link from moving the handle towards or away from the first adjustable length support arm when the pivot link is rotated about the pivot axis; and the second degree of freedom between the latch bolt and pivot link is configured to prevent or limit the pivot link from moving the latch bolt towards or away from front and rear sides of the shelf when the pivot link is rotated about the pivot axis.

15. The pullout shelf assembly of claim 1, wherein the latch arrangement includes a latch bolt carrier defining a trough, the latch bolt carrier is mounted to an underside of the shelf, the latch bolt is configured to be slidably carried within the trough between the latch bolt carrier and the underside of the shelf.

16. The pullout shelf assembly of claim 1, wherein the shelf includes a frame work and a product support panel mounted to the frame work, the frame work including at least one notch, the notch slidably receiving the handle therein.

* * * * *